United States Patent [19]

Scherbing

[11] 4,083,211

[45] Apr. 11, 1978

[54] AXIAL SPLIT-PIN TUMBLER-TYPE LOCK MECHANISM FOR A HANDLE LOCK

[75] Inventor: Frank J. Scherbing, Chicago, Ill.

[73] Assignee: Chicago Lock Co., Chicago, Ill.

[21] Appl. No.: 788,249

[22] Filed: Apr. 18, 1977

[51] Int. Cl.[2] ..... E05B 27/08

[52] U.S. Cl. ..... 70/363; 70/467

[58] Field of Search ..... 70/363, 208, 145, 489, 70/467

[56] References Cited

U.S. PATENT DOCUMENTS

| | | | |
|---|---|---|---|
| 1,696,829 | 12/1928 | Wise | 70/363 |
| 3,102,412 | 9/1963 | Christopher | 70/363 |
| 3,213,654 | 10/1965 | Davenbaugh | 70/208 |
| 3,234,765 | 2/1966 | Kerr | 70/208 |

*Primary Examiner*—Robert L. Wolfe
*Attorney, Agent, or Firm*—Norman H. Gerlach

[57] ABSTRACT

An axial split-pin tumbler-type lock mechanism for a handle lock and of the type including a lock cylinder, a forwardly disposed operating part rotatable in the cylinder, a rearwardly disposed stationary sleeve in the cylinder and adjoining the operating part at a transverse interfacial plane, the operating part including a shaft extending axially through the sleeve, the key-operated spring-pressed axially movable split-pin tumblers carried in bores in the operating part and the sleeve and movable into positions alternately serving to secure the operating part and the sleeve against relative rotation and to free the operating part for rotation to operate the lock mechanism, includes a bolt holder integral with the sleeve part and disposed rearwardly thereof, the holder having a bolt race extending transversely therein, and a lock bolt mounted in the race for transverse sliding movement therein between unlocking and locking positions, the bolt having means cooperating with coupling means on the distal end of the shaft for moving the bolt between such positions in response to rotation of the operating part.

5 Claims, 7 Drawing Figures

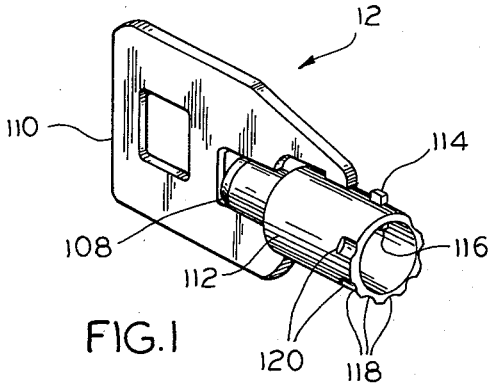
FIG.1
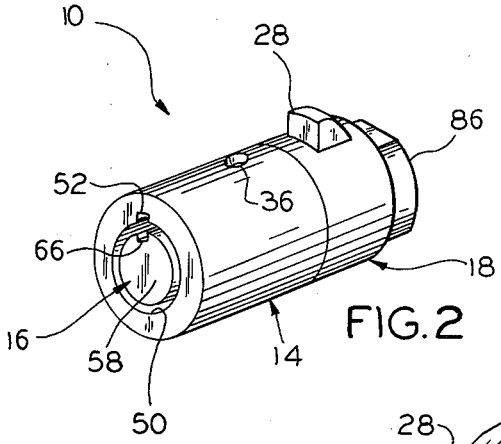
FIG.2
FIG.3
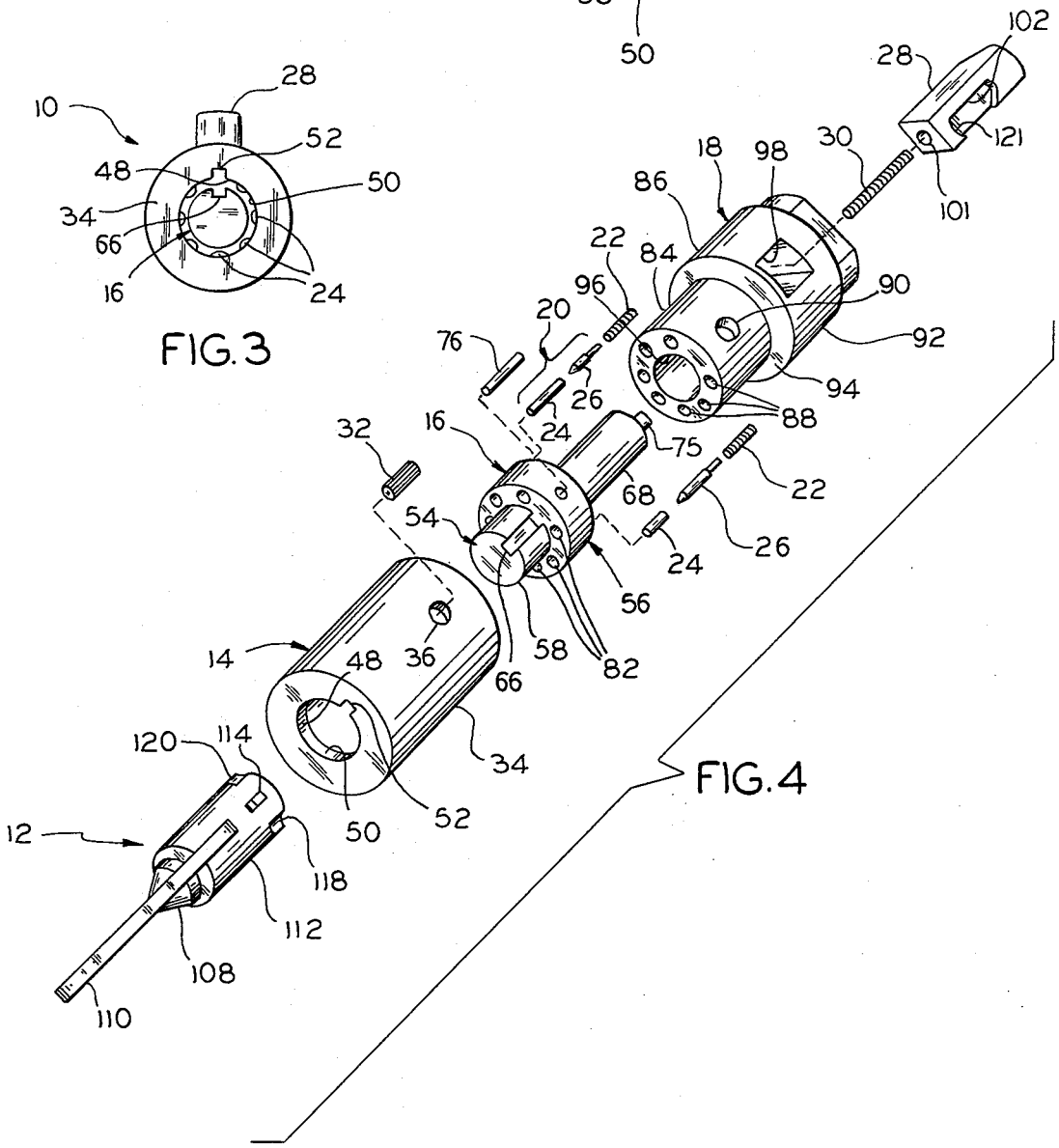
FIG.4

AXIAL SPLIT-PIN TUMBLER-TYPE LOCK MECHANISM FOR A HANDLE LOCK

BACKGROUND OF THE INVENTION

This invention relates to an axial split-pin tumbler-type lock mechanism for a handle lock, including a bolt holder forming part of the lock mechanism and a lock bolt mounted in the holder and adapted to project laterally outwardly from the lock for locking purposes.

A handle lock is a type of locking assembly employed frequently on vending machine cabinets and the like. It includes a tubular casing which receives the cylindrical body of a "pop-out" rotatable handle. A cylinder lock is mounted in the handle body, and it operates a lock bolt which projects laterally to secure the handle body to the casing. Operation of the cylinder lock moves the lock bolt into a retracted unlocking position, which releases the handle, so that it pops out of the casing under spring pressure and may be turned for opening a cabient door or the like.

In the past, the axial split-pin tumbler-type lock mechanisms employed in the handles of the handle locks have been constructed in four principal parts or pieces, namely, an outer cylinder, an inner cylinder, a forwardly disposed operating or spindle part mounted in the inner cylinder, and a rearwardly disposed stationary sleeve part mounted in the inner cylinder. A lock bolt has been movably mounted in the outer cylinder, adjacent to the sleeve part and coupled with the operating part, for transverse movement in and out of the outer cylinder in response to rotation of the operating part.

SUMMARY OF THE INVENTION

The present invention provides an axial split-pin tumbler-type lock mechanism for a handle lock which reduces to three the number of principal parts. In particular, a bolt holder is made integral with a sleeve, and the former outer cylinder is dispensed with. The lesser number of parts reduces the number of manufacturing operations required and also reduces inventory requirements. Assembly of the lock mechanism is faster and more economical.

In a preferred embodiment of the invention, the integral sleeve and bolt holder are constructed of molded plastic. This structure has several advantages, including economy of material and lightness in weight. It is especially advantageous that holes and recesses are formed therein by molding, rather than by metal removing and finishing operations. In particular, the tumbler bores which were drilled in the metal sleeve part previously used are formed by molding in the new plastic part.

The invention in its broader aspects provides an axial split-pin tumbler-type lock mechanism including a lock cylinder, a forwardly disposed operating part rotatable in the cylinder, a rearwardly disposed stationary sleeve in the cylinder and adjoining the operating part at a transverse interfacial plane, the operating part including a shaft extending axially through the sleeve and coupling means on the distal end of the shaft, axially movable split-pin tumblers carried in longitudinal bores in the operating part and the sleeve and each tumbler having a forwardly disposed driver element and a rearwardly disposed follower element adjoining each other when in aligned bores, spring means yieldingly urging the tumblers forwardly to bridge the interfacial plane by the follower elements and thereby secure the parts against relative rotation, the driver elements having front ends engageable with a key to move the tumblers rearwardly so that the joints between their elements coincide with the interfacial plane to free the operating part for rotation, a bolt holder integral with the sleeve and disposed rearwardly thereof, the holder having a bolt race extending transversely therein, and a lock bolt mounted in the race for transverse sliding movement therein between a retracted unlocking position and an extended locking position wherein the bolt projects laterally outwardly from the holder, the bolt having means cooperating with the coupling means for moving the bolt between its said positions in response to rotation of the operating part.

BRIEF DESCRIPTION OF THE DRAWINGS

The attached drawings illustrate a preferred embodiment of the lock mechanism of the invention, without limitation thereto. In the drawings, like elements are identified by like reference symbols in each of the views, and:

FIG. 1 is a perspective view of a key which cooperates with the lock mechanism of FIG. 2;

FIG. 2 is a front perspective view of a lock mechanism or lock, in accordance with the invention;

FIG. 3 is a front end elevational view of the lock mechanism;

FIG. 4 is an exploded perspective view of the lock mechanism and key;

DESCRIPTION OF THE PREFERRED EMBODIMENT

Figure 5:
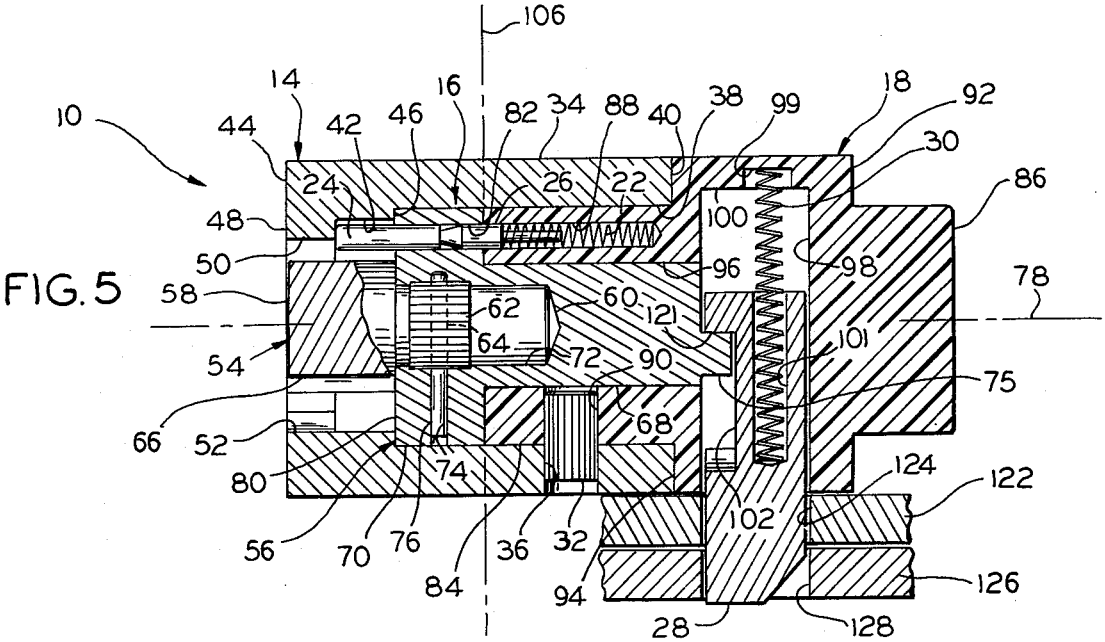
FIG. 5 is an enlarged longitudinal sectional view of the lock mechanism, shown with the lock bolt thereof in locking engagement with adjacent portions of a handle body and the casing of a handle mount.

Referring to the drawings, particularly FIGS. 1–4, an axial split-pin tumbler-type lock mechanism or lock 10 is employed with a key 12. The lock mechanism and key are of the same general types as illustrated in U.S. Pat. No. 3,102,412, but with structure adapting the lock mechanism for use in a handle lock, as described hereinafter.

The lock mechanism 10 includes, as its principal parts, a lock cylinder 14, an operating part 16, and a composite sleeve and bolt holder part 18. The lock mechanism also includes a plurality of tumblers 20, which are seven in number, and a like number of coil compression tumbler springs 22, but two sets of tumblers and springs being illustrated in FIG. 4. Each tumbler is composed of a driver element or pin 24 and a follower or locking element or pin 26. The lock mechanism further includes a lock bolt 28 and a coil compression bolt spring 30. The components of the lock mechanism 10 are secured together by means of a mounting pin 32.

Referring to FIGS. 4–7, in particular, the lock cylinder 14 includes a cylindrical tubular body 34 having a smooth outer surface. The body is provided with a radial hole 36 which receives the mounting pin 32. The body 34 has a longitudinal cylindrical bore 38 extending forwardly from its rear end 40. A second longitudinal cylindrical bore 42 of reduced diameter is provided in the body 34 adjacent to its front end 44. An annular shoulder 46 is formed at the junction of the bores 38 and 42, and it serves for retention of the operating part 16 within the body 34. An annular closure flange 48 extends radially inwardly from the body 34 at the front end 44 thereof, and it defines a circular key opening 50. A key guide notch 52 extends radially outwardly from the inner edge of the closure flange 48.

The operating part 16 in the illustrative embodiment includes a post unit 54 and a spindle unit 56. The post unit 54 includes a generally cylindrical key guide post 58 and an integral coaxial generally cylindrical shank 60 of reduced diameter, having a slightly enlarged knurl ring 62 therearound, and a pin hole 64 extending diametrically therethrough. The post 58 has a longitudinal drive notch 66 along the side thereof, and otherwise has a smooth cylindrical outer surface.

The spindle unit 56 includes a cylindrical lock shift 68 and an integral cylindrical head 70 of greater diameter. The diameter of the head is approximately the same as but slightly smaller than the diameter of the cylinder bore 38. An axial cylindrical blind bore 72 extends through the head 70 and into the shaft 68. A radial pin bore 74 is provided in the head 70, and it intersects the axial bore 72. A lock pin 75 is integral with the distal end of the shaft 68 and extends longitudinally outwardly therefrom and eccentrically with respect to its longitudinal axis.

The operating part 16 is assembled by driving the post unit 54, particularly the shank 60 thereof, into the axial bore 72, with the knurl ring 62 providing a tight drive fit, so that the post unit 54 and the spindle unit 56 are rigidly fixed relative to each other in the resulting assembly. In addition, in a preferred embodiment, a friction pin 76 is inserted in the radial pin bore 74 in the head 70 and through the pin hole 64 in the shank 60, to secure the units against relative movement. The pin 76 preferably is constructed of hard metal, so that it serves an additional function in resisting a cutting tool which might be used in an attempt to defeat the lock. The post unit 54 also may be constructed of a very hard metal, to thwart attempts to drill through the lock in this area. Alternatively, the operating part 16 may be constructed in other ways, with any of the post 58, the shaft 68 and the head 70 constructed separately or integrally with some or all of the remaining components, as most desirable for manufacturing and intended use.

The operating part 16 is rotatable in the cylinder 14 about the longitudinal axis 78 of the cylinder, which axis is also the axis of the post 58, the head 70, and the shaft 68. The head 70 is provided with a planar front face 80 perpendicular to the axis 78 and adjacent to the retention shoulder 46 on the lock cylinder 14. An annular series of longitudinal cylindrical tumbler bores 82 is provided in the head 70. The bores 82 extend through the head 70 and are spaced outwardly from the post 58. There are seven such bores in the illustrative embodiment spaced at angles of 45° from each other, except for a 90° spacing between two of the bores. The bores 82 all have the same diameter and are disposed at equal radii from the axis 78. The longitudinal axes or centers of the bores 82 lie approximately along the inner edge of the closure flange 48 when viewed from the front, as illustrated in FIG. 3.

The composite part 18 includes a sleeve 84 and a bolt holder 86 integral therewith. The sleeve 84 is a cylindrical tubular member, having an outside diameter approximately the same as but slightly smaller than the diameter of the cylinder bore 38. The sleeve 84 is provided with an annular series of longitudinal cylindrical tumbler blind bores 88 having the same diameters, spacing, and radial distance from the longitudinal axis of the sleeve as the head bores 82. A radial mounting bore 90 is provided in the sleeve 84.

The bolt holder 86 includes a cylindrical body 92 of greater diameter than the sleeve 84, thereby forming a shoulder 94 at their juncture. The diameter of the body 92 is substantially the same as the outside diameter of the lock cylinder body 34, and the outer cylindrical surface of the body 92 is essentially smooth.

The composite part 18 is provided with a shaft bore 96, which extends axially through the sleeve 84 and into the holder body 92. The shaft bore 96 has a diameter slightly greater than the lock shaft 68. The shaft bore 96 terminates at a generally rectangular transverse lock bolt race 98 formed in the bolt holder 86 and which extends to one side of the holder body 92. The elongated lock bolt 28 of like generally rectangular cross section is mounted in the race 98, for transverse sliding movement from a rectracted unlocking position in the holder body 92, to an extended locking position wherein the bolt projects laterally outwardly from the holder body. A cylindrical spring-mounting recess 99 is provided in the holder body 92 at the inner end 100 of the bolt race 98. The recess 99 serves to receive the coil compression spring 30, and the outer end of the spring is received in a cylindrical socket 101 in the inner end of the lock bolt, urging the bolt outwardly. A coupling groove 102 is formed in the surface of the lock bolt 28 which faces the shaft bore 96.

The sleeve 84 is received in the lock cylinder body 34 at the rear end 40 thereof, and its front face adjoins the rear face of the spindle head 70 at a transverse interfacial plane 106. The shoulder 94 of the holder body 92 abuts on the rear end 40 of the cylinder body 34, and the cylindrical outer surfaces of the respective bodies are substantially flush with each other. The longitudinal axis of the shaft bore 96 coincides with the longitudinal axis 78 of the lock cylinder 14. The lock shaft 68 is journaled in the shaft bore 96. The lock pin 75 is received in the coupling groove 102 in the lock bolt 28, thereby coupling the distal end of the shaft 68 to the lock bolt and securing the bolt in the holder 86. The composite part 18 is secured to the lock cylinder 14 by insertion of the mounting pin 32 in the cylinder mounting hole 36 and the aligned sleeve mounting bore 90, with a drive fit therein. The composite part 18 serves to retain the operating part 16 within the lock cylinder 14 and rotatable therein.

The operating part 16 is rotatable to move the head bores 82 into and out of alignment or register with respective sleeve bores 88. The construction and mode of operation of the tumblers 20 and the tumbler springs 22 are conventional. In general, the driver elements 24 are received in the head bores 82, and the follower elements 26 are received in the sleeve bores 88 and seated on the springs 22. When the tumbler bores 82 and 88 are in alignment and in the absence of a key, in an initial condition illustrated in FIG. 5, the springs 22 yieldingly urge the tumbler elements 24 and 26 forwardly into positions wherein the interfacial plane 106 is bridged by the follower elements 26 to secure the operating part 16 and the sleeve 84 against relative rotation. At this time, the front ends of the driver elements 24 abut on the inner surface of the closure flange 48 therearound, with a portion of each driver element accessible to the key 12 through the key opening 50, as illustrated in FIGS. 3 and 5.

Referring to FIG. 1, the key 12 is a conventional structure, which includes a body 108 connected to a wing-type torque-applying or manipulating handle 110. The body 108 includes a cylindrical tubular shank 112. Adjacent to the outer end of the shank 112, a longitudinally extending guide lug 114 extends radially outwardly from the shank, and a longitudinally extending drive lug 116 extends radially inwardly from the shank. Grooves 118 are formed in the outer surface of the shank 112, and they extend longitudinally from the outer end thereof and terminate a bittings or shoulders 120. The grooves 118 and corresponding bittings 120 each are seven in number and spaced apart at angles of 45°, except for two of each which are on opposite sides of the lugs and spaced apart 90°, in like manner to the tumbler bores 82 and 88.

Figure 6:
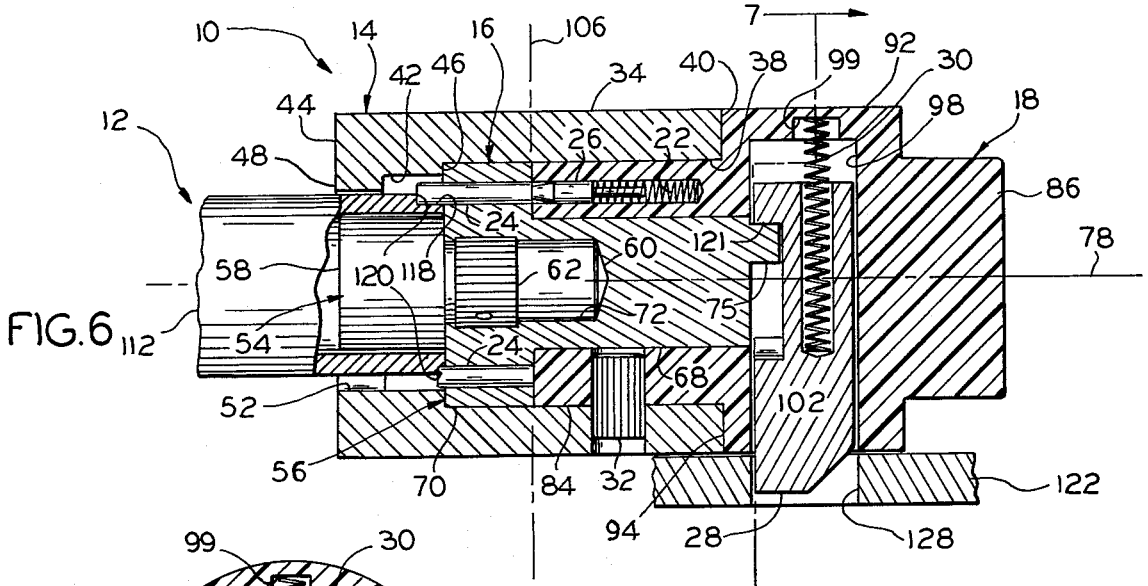
FIG. 6 is a view similar to FIG. 5, but illustrating a portion of the key of FIG. 1 engaging the lock tumblers to free an operating part of the mechanism for rotation, and with the operating part rotated to place the lock bolt in an unlocking position.
Figure 7:
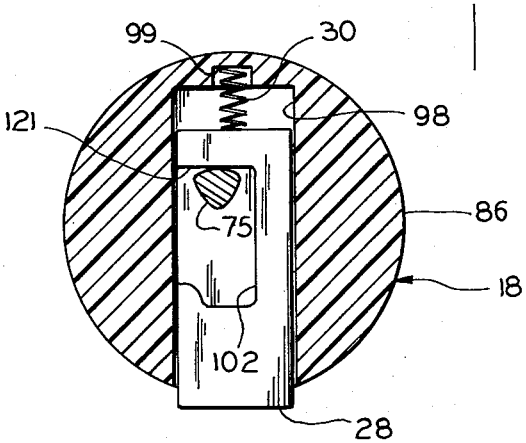
FIG. 7 is a transverse sectional view of the lock mechanism, taken substantially on lines 7—7 of FIG. 6.

The key 12 is inserted in the lock mechanism 10 by inserting the shank 112 in the key opening 50 and around the guide post 58. The guide lug 114 on the key is inserted in the guide notch 52 in the closure flange 48, and the drive lug 116 is inserted in the drive notch 66 in the post. The drive elements 24 of the tumblers 20 in part are received in the key grooves 118, and the front ends of the driver elements abuttingly engage the key bittings 120. Rearward movement of the key 12 moves the tumblers 20 in aligned tumbler bores 82 and 88 rearwardly, until the shank 112 of the key bottoms on the front face 80 of the spindle head 70, as illustrated in FIG. 6. At this time, the joints between the tumbler elements 24 and 26 coincide with the interfacial plane 106, and the guide lug 114 on the key is disposed rearwardly of the closure flange 48, so that the operating part 16 may be rotated by rotation of the key, to thereby operate the lock mechanism 10.

The lock shaft 68 rotates as the operating part 16 rotates, and the lock pin 75 rotates eccentrically in the coupling groove 102 of the lock bolt 28. The lock pin 75 is maintained in engagement with the inner end wall 121 of the groove 102, owing to the outward pressure exerted on the lock bolt by the bolt spring 30. Consequently, transverse displacement of the lock pin 75 caused by rotation of the shaft 68 serves to move the lock bolt 28 back and forth in the bolt race 98: as the lock pin 75 moves toward the open outer end of the race 98, the pressure of the bolt spring 30 moves the lock bolt outwardly; as the lock pin 75 moves toward the inner end 100 of the race 98, it engages the inner end wall 121 of the coupling groove 102, to move the lock bolt 28 inwardly against the pressure of the spring 30. In the illustrative embodiment, the lock bolt 28 is in its extended locking position, at its greatest lateral projection, when the lock mechanism 10 is in its locked condition, as illustrated in FIG. 5. The lock bolt 28 is in a retracted unlocking position when the lock mechanism 10 is in its unlocked condition and the operating part 16 is rotated approximately 120° in the clockwise direction (viewed from the front end 44), as illustrated in FIG. 6.

As described above, the lock mechanism 10 is designed to be mounted in a cylindrical tubular handle body 122, a wall portion of which is illustrated in FIGS. 5 and 6. The adjoining flush cylindrical surfaces on the lock cylinder body 34 and the holder body 92 fit snugly within the handle body 122, and the bolt race 98 is aligned or registers with a corresponding opening 124 in the body. As illustrated in FIG. 6, the lock bolt 28 when in its retracted unlocking position continues to project a short distance beyond the outer surface of the holder body 92, into the opening 124 in the handle body 122, to thereby retain the lock mechanism 10 within the handle body. At the same time, clearance remains between the inner end 100 of the bolt race 98 and the inner end of the lock bolt 28, which enables the lock bolt to be pushed further into the race 98 and out of the handle body opening 124. The lock mechanism 10 then may be withdrawn from the handle body 122 in the longitudinal direction.

With the lock mechanism 10 inserted in the handle body 122, the handle body in turn is inserted in the tubular casing 126 of a handle mount, a wall portion of which is illustrated in FIG. 5. The casing 126 is provided with an opening 128 arranged for registry with the handle body opening 124 and the bolt race 98. When the lock bolt 28 is in its outermost extended position, illustrated in FIG. 5, the bolt serves to bridge across the walls of the handle body 122 and the casing 126, to thereby lock them against rotation and longitudinal movement relative to each other.

Upon withdrawal of the lock bolt 28 to the position illustrated in FIG. 6, by operation of the lock mechanism 10, the handle body 122 is free to move longitudinally outwardly, which may take place in the direction of the front end 44 under the pressure of a "pop-out" spring, not shown, and the handle body also is free to rotate. The handle of which the body 122 forms a part then may be turned to move a cam or other suitable member, for opening a cabinet door or the like. The key 12 may be returned to its original rotational position and removed, while the lock bolt 28 engages the inner surface of the casing 126 to hold it in a retracted position. Thereafter, the cabinet door or the like may be closed, the handle rotated to secure the door, and the handle pushed inwardly toward the casing 126, all in accordance with the usual manner of operation of a handle lock, until the lock bolt 28 is aligned with the casing opening 128, and the bolt enters the opening under the pressure of the bolt spring 30 to lock the unit once more.

While the lock mechanism 10 may be constructed entirely of metal components, as in prior structures, it is preferred in the invention to construct the composite part 18 as a one-piece molded part formed of a suitable hard plastic composition, such as nylon filled with glass fibers. The integration of the sleeve 84 and the bolt holder 86 in the unitary part 18 increases the strength of each of the component members. The sleeve bores 88, the mounting bore 90, the shaft bore 96, and the bolt race 98 all may be formed by molding, to effect considerable economies in manufacture, in addition to the lowered cost of the material of construction. Thus, no drilling or reaming is required with the plastic part 18. Assembly labor also is reduced, and a reduction in parts inventory is effected.

While a preferred embodiment of the invention has been illustrated and described, and reference has been made to certain changes and modifications which may be made in the embodiment, it will be apparent that further changes and modifications may be made therein within the spirit and scope of the invention. It is intended that all such changes and modifications be included within the scope of the appended claims.

Having thus described the invention, what I claim as new and desire to secure by Letters Patent is:

1. In an axial split-pin tumbler-type lock mechanism, said mechaism including a lock cylinder, a forwardly disposed operating part secured within said cylinder and rotatable about a longitudinal axis extending between front and rear ends thereof, a rearwardly disposed stationary sleeve secured within said cylinder and adjoining the operating part at a transverse interfacial plane, said operating part including a shaft extending axially through said sleeve and coupling means on the distal end of the shaft, means forming longitudinal bores in said operating part and said sleeve respectively and movable into and out of alignment upon rotation of the operating part, axially movable split-pin tumblers carried in said bores and each having a forwardly disposed driver element and a separate rearwardly disposed follower element adjoining each other when in aligned bores, and spring means yieldingly urging said tumblers in aligned bores forwardly to positions wherein said interfacial plane is bridged by said follower elements to secure the operating part and the sleeve against relative rotation, said driver elements having front ends engageable with a key, whereby rearward movement of the key moves said tumblers in aligned bores rearwardly to positions wherein the joints between the tumbler elements coincide with said interfacial plane to free said operating part for rotation, a bolt holder integral with said sleeve and disposed rearwardly thereof, said holder having a bolt race extending transversely therein, and a lock bolt mounted in said race for transverse sliding movement therein between a retracted unlocking position and an extended locking position wherein the bolt projects laterally outwardly from the holder, said bolt having means cooperating with said coupling means for moving the bolt between its said positions in response to rotation of said operating part.

2. A lock mechanism as defined in claim 1 and wherein said lock cylinder is provided with a smooth substantially cylindrical outer surface, and said holder is provided with a smooth substantially cylindrical outer surface which is substantially flush with said outer surface of the lock cylinder.

3. A lock mechanism as defined in claim 1 and wherein said sleeve and said holder together comprise a one-piece molded plastic part having said sleeve bores formed by molding.

4. In an axial split-pin tumbler-type lock mechanism, said mechanism including a lock cylinder provided with a smooth substantially cylindrical outer surface, a forwardly disposed operating part secured within said cylinder and rotatable about a longitudinal axis extending between front and rear ends thereof, a rearwardly disposed stationary sleeve secured within said cylinder and adjoining the operating part at a transverse interfacial plane, said operating part including a shaft extending axially through said sleeve and a lock pin integral with the distal end of the shaft and extending longitudinally outwardly therefrom and eccentrically with respect to said axis, means forming longitudinal bores in said operating part and said sleeve respectively and movable into and out of alignment upon rotation of the operating part, axially movable split-pin tumblers carried in said bores and each having a forwardly disposed driver element and a separate rearwardly disposed follower element adjoining each other when in aligned bores, and spring means yieldingly urging said tumblers in aligned bores forwardly to positions wherein said interfacial plane is bridged by said follower elements to secure the operating part and the sleeve against relative rotation, said driver elements having front ends engageable with a key, whereby rearward movement of the key moves said tumblers in aligned bores rearwardly to positions wherein the joints between the tumbler elements coincide with said interfacial plane to free said operating part for rotation, a bolt holder integral with said sleeve and disposed rearwardly thereof, said holder being provided with a smooth substantially cylindrical outer surface which is substantially flush with said outer surface of the lock cylinder, said holder having a bolt race extending transversely therein, and a lock bolt mounted in said race for transverse sliding movement therein between a retracted unlocking position and an extended locking position wherein the bolt projects laterally outwardly from the holder, said bolt having groove means receiving said lock pin therein for moving the bolt between its said positions in response to rotation of said operating part.

5. A lock mechanism as defined in claim 4 and wherein said sleeve and said holder together comprise a one-piece molded plastic part having said sleeve bores formed by molding.

* * * * *